United States Patent [19]

Arend

[11] Patent Number: 4,822,177

[45] Date of Patent: Apr. 18, 1989

[54] CARRYING BAG, PARTICULARLY BATHING BAG

[76] Inventor: Arnold Arend, Mainzerlandstrasse 782, 6000 Frankfurt 80, Fed. Rep. of Germany

[21] Appl. No.: 227,750

[22] Filed: Aug. 3, 1988

[30] Foreign Application Priority Data

Aug. 14, 1987 [DE] Fed. Rep. of Germany ..... 8711072
Jan. 4, 1988 [DE] Fed. Rep. of Germany ..... 8800021

[51] Int. Cl.[4] ..... B65D 30/00

[52] U.S. Cl. ..... 383/4; 383/75; 383/123

[58] Field of Search ..... 383/4, 71, 74, 75, 76, 383/72, 123; 493/225, 226; 190/2; 272/104

[56] References Cited

U.S. PATENT DOCUMENTS 3,847,194 11/1974 Corigliano ..... 383/4
3,879,775 4/1975 Iwata ..... 383/4
4,197,891 4/1980 Comolco ..... 385/4
4,671,393 6/1987 Rainey ..... 383/4
4,723,300 2/1988 Aranow ..... 383/4
4,738,545 4/1988 Westgor ..... 383/75

FOREIGN PATENT DOCUMENTS 2047548 9/1969 Fed. Rep. of Germany ..... 383/4

*Primary Examiner*—Willis Little
*Attorney, Agent, or Firm*—Cooper & Dunham

[57] ABSTRACT

A carrying bag, particularly a bathing bag, comprises a pattern folded about a folding line whereby pattern sections folded one upon the other are bonded to one another on at least two edges. In order to keep the interior of the carrying bag easily accessible and to be able to use this carrying bag as a substratum, the pattern is provided on one inner side along its outer edges with releasable closure elements; and on one pattern section, essentially along the outer edges thereof, a cord may be moved in guiding element the ends of which cord are arranged near the folding line of the pattern.

26 Claims, 3 Drawing Sheets

CARRYING BAG, PARTICULARLY BATHING BAG

BACKGROUND OF THE INVENTION

This invention relates to a carrying bag, particularly a bathing bag, comprising a flexible sheet article of generally rectangular shape (hereinafter sometimes referred to as a "rectangular pattern" or "the pattern") folded about a folding line, wherein portions of the sheet article (hereinafter sometimes referred to as "pattern sections") folde one upon the other are secured to one another on at least two edges.

In prior art carrying bags of this type, the edges of the folded pattern, with the exception of an opening on the side opposite the folding line, are solidly connected with one another, for instance by sewing or, if the pattern consists of a plastic material, by welding. The interior of the bag is accessible only through the upper opening opposite the folding line. If the carrying bag is to be used as a bathing bag, it is in most cases necessary with a view to the restricted capacity of the carrying bag, to also take along a substratum, for instance a bathing towel, separately, i.e. outside of the carrying bag. This is inconvenient and includes the danger that one of the two items, either carrying bag or towel, will be lost.

SUMMARY OF THE INVENTION

It is an object of the present invention to provide a carrying bag of the type described above, so arranged that the interior thereof is easily accessible and that it may be used, at the same time, as a relatively large-area substratum.

To these and other ends, the pattern is provided on one inner side along its edges with releasable closure elements, and on one pattern section substantially along the outer edges thereof, a cord is provided together with guiding elements in which the cord may be moved, the ends of the cord being secured near the folding line of the pattern. The inner side of the pattern is that side which lies inside if the pattern sections are folded one upon the other along the folding line. The so-called outer edges include all edges of the pattern with the exception of the edge which is formed on the folding line by the folding.

A substantial advantage of the carrying bag consists in that, to start with, all the objects to be stowed therein may be put on the spread-out pattern. Nevertheless, after closing the bag, which is completely effected by the cooperation of the closure elements along the edges, these objects are well secured for this reason against beinhg dropped or inadmissible removal. The closed carrying bag is easy to carry. This is particularly true since the closed carrying bag is folded once again in parallel relative to the abovereferenced folding line thus practically halving its height and is gripped by handle elements provided on the two outer sides on top. In particular, the cord, which may be moved along the outer edges (and to this end is for instance sewn in or threaded through rings), serves as a handle element. The carrying bag may then be carried in the shape of a sack. In the spread-out state of the pattern with the closure elements having been released and with the stowed objects taken out, this bag offers a large-area substratum, or lying towel, which can be used on a bathing site. It is therefore not necessary to take a special blanket along.

As an advantageous further development of the carrying bag, the guiding elements of the cord are arranged on the outer side of the pattern and along the cord in a spaced relationship relative to each other, so that the cord lies open between the guiding elements. In this way, the handling of the carrying bag in the closed state is simplified since, with the exception of the folding line, it may be gripped around it at all locations at which the cord lies free between the guiding elements.

In order to be able to also grip the carrying bag at the folding line, it has advantageously further been provided that between the fastening locations of the cord and in parallel to the folding line, at the outer side of the pattern, a flat strip is arranged as a handle. The carrying bag can therefore also be gripped at the flat strip, which in the double-folded state of the bag lies on top at the same height as an open-lying cord section.

In a further development of the carrying bag which serves particularly as a bathing bag, first fastening elements are provided on the inner side of the pattern substantially in parallel relative to the closure elements, to which fastening elements a bathing towel provided with a corresponding system of second fastening elements may releasably be fastened. In this way, a double-layer lying area is obtained, the outer side of which may be spread on the ground thus retaining dirt and humidity from the bathing towel, particularly a terry cloth towel, above. The bathing towel on the other hand may be particularly soft and absorbent and may also be used as a normal towel. It is additionally of advantage that when releasing the bathing towel, it may, separately from the pattern of the bathing bag, be cleaned, for instance in a washing machine. It is of further advantage that with the pattern spread out, objects such as dresses may be stowed between the pattern and the bathing towel fastened on it so that they are no longer accessible for third persons. Between the spread-out pattern and the bathing towel to be fastened on it, a separate towel shaped as a cushion may additionally be inserted so that the spread-out bathing bag includes an elevated head end, which supports the head of the person lying on it.

The releasable closure elements provided on the pattern of the carrying bag may advantageously be provided as circulating "Velcro" closure, viz. closure elements comprising strips of material respectively bearing multiple flexible hooks and multiple flexible loops engageable by said hooks, extending along the outer edges. By them, a particularly tight closure of the bag is obtained.

In another embodiment of the bag, press buttons arranged in spaced relationship along the outer edges of the pattern may be provided as releasable closure elements. The press buttons may be so selected that the bag is relatively tightly closed on one hand, but may conveniently be opened on the other.

Analogously thereto, the first and second fastening elements serving to hold the bathing towel to the pattern may be provided as circulating "Velcro" closures. By these closures, the properties of the spread-out bathing bag as a substratum are practically not impaired, since the "Velcro" closures do not form hard spots.

On the other hand, the first and the second fastening elements may be press buttons arranged in spaced relationship relative to each other if and when their properties are desired.

To stow away smaller objects, an additional pocket may be sewn on one outer side of the pattern. The interior of this pocket is thus accessible while the carrying bag as such need not be opened at the releasable closure elements.

The pattern of the carrying bag may consist of any freely choosable textile material which possesses sufficient stability properties.

In one embodiment, the pattern may also be provided from an artificial textile material, which may have the particular advantage to prevent humidity from penetrating from the interior of the bag, or when the pattern is spread out, from the ground to the upper side of the pattern.

An advantageous further embodiment of the carrying bag, particularly bathing bag, also starts from a substantially rectangular pattern, which is folded about a first folding line at right angles relative to the pattern, which divides the pattern into two pattern sections, whereby pattern sections folded one upon the other are bonded to each other on at least two edges. In order to obtain (with regard to the forces occurring when carrying the bag) a good stability while using only little material for the manufacture of the carrying bag and for simple handling, this carrying bag is characterized in that (in addition to the features of providing releasable closure elements on an inner side of the pattern along its outer edges, and providing a cord that can be moved on a first pattern section substantially along the outer edges thereof in guiding elements) the cord is not fixedly secured near the folding line on the pattern but at each extremity is instead movably arranged along a section adjacent the outer edge on the first folding line in a guiding element, with the cord ends extending freely, i.e. movably, from the guiding elements on the folding line and being of such length that in the double-folded state of the pattern (wherein the latter is additionally folded about a second folding line along the pattern) these cord ends may frictionally be connected to one another. The cord ends are preferably knotted with one another when the carrying bag is doubly folded. In order to obtain the frictional connection of the cord ends, complicated connecting elements are not, therefore, necessary. In order to prevent the cord ends from slipping from the two guiding elements on the folding line, a knot each is provided between the guiding elements on the folding line and the next guiding element. The moving distance of the cord is therefore limited by the stop of the knot at the two last-mentioned guiding elements. If the two cord ends are frictionally connected with one another, the traction flux of force when carrying the carrying bag is closed and there are no traction forces concentrated on one application spot of the cord on the pattern. The forces occurring between the cord and the pattern are rather substantially equally transferred via a plurality of guiding elements onto the cord. This permits the pattern to be made from a relatively less sturdy textile or artificial textile material. Neither need there be any provision against the tear of the cord end from one fixation point on the pattern. With a view to the equal distribution of force, the guiding elements need not be too sophisticated either. An additional advantage of the arrangement of the cord in this embodiment is seen in that the doubly-folded carrying bag is additionally closed on one side by the frictional connection of the cord ends so that in this state the carrying bag is particularly compact.

In the latter embodiment of the carrying bag, two of the guiding elements are advantageously symmetrical relative to an assumed symmetry line in the middle at right angles relative to the first pattern section. By this arrangement, in order to carry the bag, the cord may be gripped between these two guiding elements on each of the pattern subsections formed by the second folding line. By such symmetrical gripping of the cord on two opposing locations, namely on each of the two pattern subsections, the equal transfer of force between cord and pattern is enhanced. An additional handle on the pattern is not necessary.

In order to simplify the manufacture, the latter embodiment of the carrying bag is produced including the feature that guiding elements provided on the first folding line and short as compared thereto are sewn on and that the remaining guiding elements are rings.

For application on each of the embodiments of the carrying bag mentioned, a pocket may additionally be provided which is open on top and smaller relative to one pattern section formed by the first folding line on one side thereof. This open pocket is provided on the top on one side with third fastening elements and may be fastened by them to correspondingly arranged fourth fastening elements on the inner side of the pattern section.

Exemplified embodiments of the invention will be explained in more detail in the following based on the accompanying drawings.

DETAILED DESCRIPTION

Figure 1:
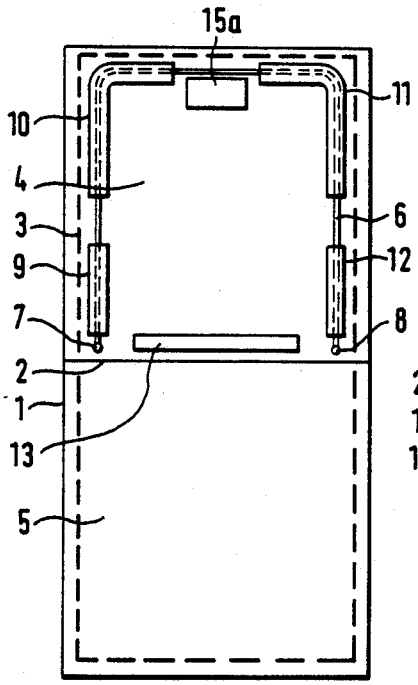
FIG. 1 is a top view on the outer side of a spread-out pattern of a first embodiment.

In FIG. 1, the numeral 1 designates a flexible sheet article or pattern of rectangular shape. It should be mentioned here that the pattern may be of different shape as well; it should, however, be plane-symmetrical relative to a folding line 2. As can be taken from FIG. 1, releasable closure elements are arranged along the outer edges of pattern 1, namely as circulating "Velcro" closure 3, shown by a dashed line since it is applied on the side of the pattern averted from the viewer which, in the unfolded state of the bag, compare FIG. 2, constitutes the inner side.

By the folding line 2, the sheet article or pattern 1 may be considered subdivided into two portions or pattern sections 4 and 5. The pattern section 4 on its outer side along the edges, with the exception of the edge along the folding line 2, includes a cord on the outer side of the pattern. The cord is arranged approximately U-shaped, on fastening spots 7 and 8 near the folding line on the pattern, and is movably guided in guiding elements 9–12. Between the individual guiding elements, the cord lies open and may be gripped.

In parallel relative to folding line 2, at the outer edge of folding section 4, a flat strip is fastened, i.e. on its left and right ends. The strip is designated by 13. Similarly to the cord sections lying free between the guiding elements, it may serve as a handle for the sack-like carrying bag. The carrying bag is formed by folding the pattern sections 4 and 5 about folding line 2, whereby the "Velcro" closures 3 of the two pattern sections adhere to each other and continuously close the carrying bag along the edge thereof, as well as by a further folding of the so-closed pattern in parallel to folding line 2.

Figure 2:
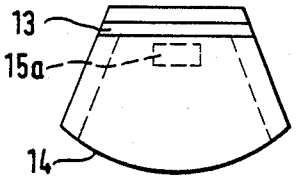
FIG. 2 is the pattern according to FIG. 1 folded to constitute a carrying bag loaded with its contents.

In FIG. 2, the carrying bag is shown in the closed state, i.e. in a situation wherein it is gripped at strip 13. Under the influence of the weight of the objects contained therein, not shown, and of the stabilizing effect of cord 6, it has the shape as shown in FIG. 2 with the bottom bulged out.

As FIGS. 1 and 2 illustrate, a small pocket 15a may be sewn onto the outer side of pattern section 4 and may be provided with a small zipper (not shown in the drawing).

It should be noted that the cord 6 may also be arranged on the pattern section in a different configuration than shown in FIG. 1, for instance in the shape of a square or a circle. The cord should, however, if possible, be provided near the outer edges of this pattern in order to be able to shape the carrying bag to the desired form when it is closed and carried. That is why the configuration of the cord is adapted to the shape of the pattern.

Figure 3:
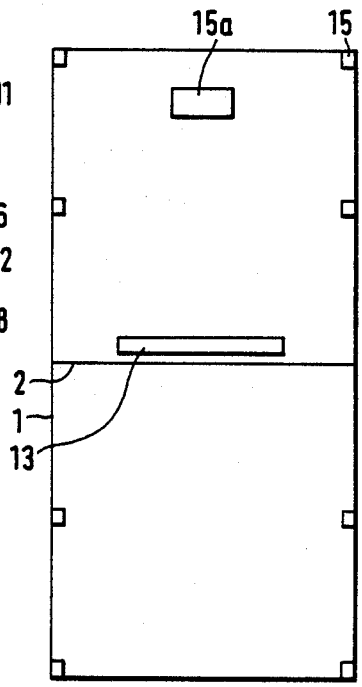
FIG. 3 is a further embodiment of the spread-out pattern, also as a top view on the outer side.

The embodiment according to FIG. 3 differs from the one in FIG. 1 only in that instead of the circulating "Velcro" closure, here individual closure elements, particularly press buttons, one of which is designated by 15, are arranged spaced relative to each other in rows which are parallel to the outer edges of the pattern. The cord and its guides here also provided are not shown in FIG. 3. Identical parts will also in the following be designated by the same reference numerals.

While the prese buttons have to be closed individually, the effect with a view to the tight consecutive arrangement thereof along the edge is practically the same as in the case of the circulating "Velcro" closure in the first embodiment according to FIG. 1. That is also why the pattern 1, if folded to constitute a carrying bag receiving objects and being held on strip 13, practically takes the same shape as shown in FIG. 2.

A third embodiment of the pattern shown in FIG. 4 has again (like the embodiment of FIG. 1) been provided with a circulating "Velcro" closure 3 as releasable closure elements, but includes in parallel thereto staggered towards the interior of the pattern and also on the inner side, additional fastening elements one of which is designated by 16. The fastening elements may be provided as press buttons. In a different embodiment, the fastening elements may, however, also be formed by "Velcro" closure sections which do not produce pressure marks when the spread-out pattern is used as a substratum.

Figure 5:
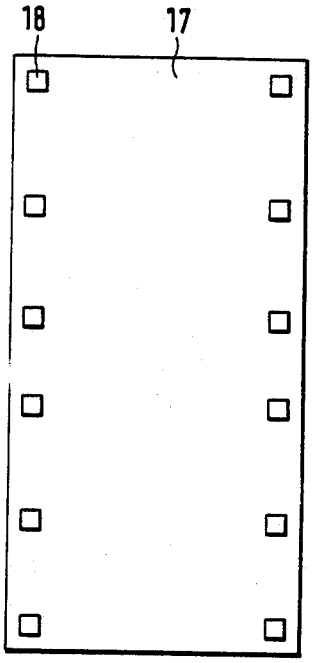
FIG. 5 is a bathing towel belonging to the pattern according to FIG. 4 as a top view on the under side.

The fastening elements exemplified by element 16 serve for fastening a bathing towel shown in FIG. 5 and carrying the reference numeral 17. The bathing towel is preferably similar in shape to, but somewhat smaller than, the pattern of the bathing bag. The towel includes an arrangement of fastening elements, one of which is designated by 18. The fastening elements of the bathing towel are referred to as second fastening elements in order to differentiate them from the first fastening elements, e.g. 16, of the substratum cloth. The first and the second fastening elements are so arranged on the pattern 1, and the bathing towel 17, respectively, that they engage or interconnect with one another when the bathing towel 17 is laid on the inner side of pattern 1 thus releasably securing the bathing towel 17 to the pattern 1. When the bathing towel 17 is fastened to the inner side of pattern 1, it may be folded together with it to form the carrying bag. In the first instance, however, the bathing towel serves as a convenient substratum on the spread-out pattern when the outer side of the pattern is spread on the ground. On the other hand, the bathing towel 17 may be disconnected from the pattern 1 either to serve for drying a bathing person or, released from the pattern, to simply be washed and/or dried.

Figure 4:
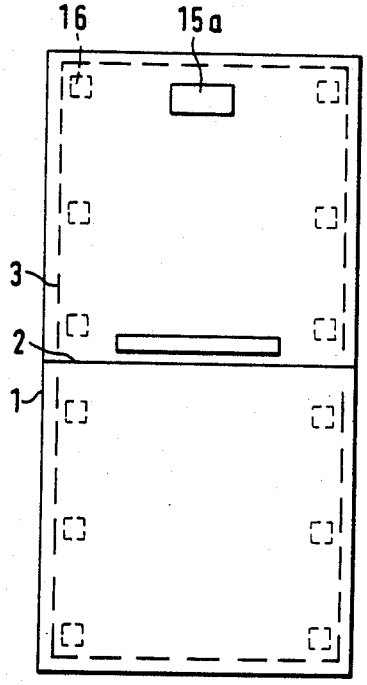
FIG. 4 is a further embodiment of the pattern also as a top view on the outer side.

It should be noted that in a further embodiment of FIGS. 4 and 5, instead of the discrete fastening elements, e.g. 16 and 18, a circulating "Velcro" closure strip each may be employed as the first and second fastening elements.

Finally, it is also possible to sew together the pattern of the bathing bag and the bathing towel, particularly if the pattern and the bathing towel are of a material which has similar washing properties since in such a case the bathing towel cannot be changed without the pattern.

Figure 6:
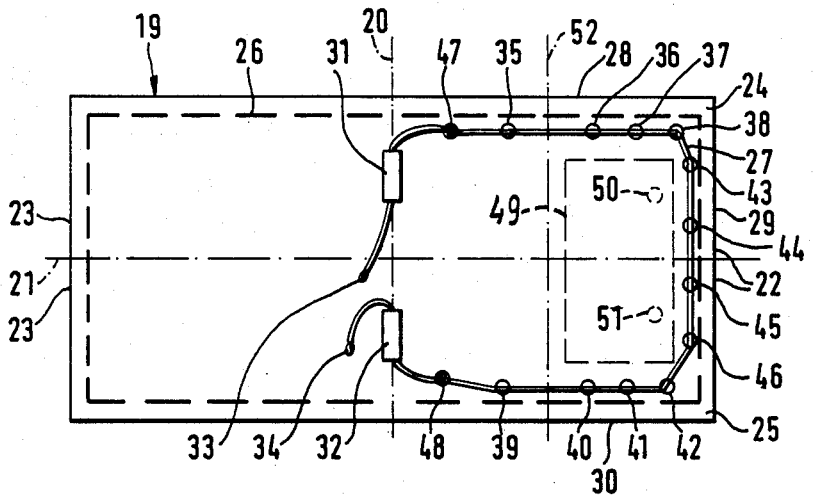
FIG. 6 is a top view on the outer side of a spread-out pattern including the elements arranged on it in a second embodiment including a smaller pocket applied thereon.

In FIG. 6, a pattern of a further preferred embodiment is designated by 19. It is plane-symmetrical to a first folding line 20, which is at right angles relative to the pattern as well as to a second folding line 21, which is directed in longitudinal direction (i.e. parallel to the long dimension of the pattern). By the first folding line, the pattern may be considered subdivided into two pattern sections 22 and 23. By the second folding line 21, a further subdivision of the pattern sections is provided into pattern subsections, of which the pattern subsections of pattern section 22 are designated by 24 and 25.

In FIG. 6, the course of releasable closure elements 26 along the outer edges of the pattern is again shown by a dashed line. The closure elements may be provided as a circulating "Velcro" closure. The closure elements are arranged analogously to FIG. 1 on the viewer's averted side of the pattern which forms the inner side.

On the outer side of the pattern, a cord 27 is guided such that the course of the cord is similar to a not-completely closed rectangle having flattened corners. The guiding of the cord, as in the first embodiment, is again predominantly arranged near the outer edges 28–30 of the first pattern section 22. Additionally, however, the guiding of the cord extends to a guiding element 31, or 32, respectively, which is sewn at the folding line 20 on the pattern. Free ends 33, 34 of the cord each terminating in a thickening, extend from these guiding elements. The remaining guiding elements are shaped as simple rings extending through the pattern, it being sufficient to provide four such rings 35–38 at the outer edge 28, four more rings 39–42 at the outer edge 30, and four further rings 43–46 at the outer edge 29. In order to prevent the cord ends or the free ends 33, 34, respectively, of the cord from being involuntarily drawn out of the guiding element, one knot each 47 or 48, respectively, may be provided on the cord between the guiding element 31 and the neighboring ring 35, or guiding element 32 and the neighboring ring 39, respectively.

From FIG. 6, it can additionally be seen that a small pocket 49, which is shown by a dashed line on the inner side of the pattern, is fastened, by press buttons 50, 51, to the pattern. The pocket is open on one side to separately receive smaller objects. The pocket may advantageously be unbuttoned for instance to be taken along by the owner if he or she leaves the pattern which forms the greater foldable bag and which also can serve as a substratum.

In FIG. 6, also, a dash-dotted symmetry line 52 shows the arrangement of two neighboring rings 35, 36 and 39, 40, respectively, symmetrical relative thereto. Between these two rings, the cord may be gripped at each pattern subsection and may be held like a handle of the bag. Such a handle is shown at reference numeral 53 in FIG. 7, wherein the pattern doubly folded relative to the carrying bag is shown.

Figure 7:
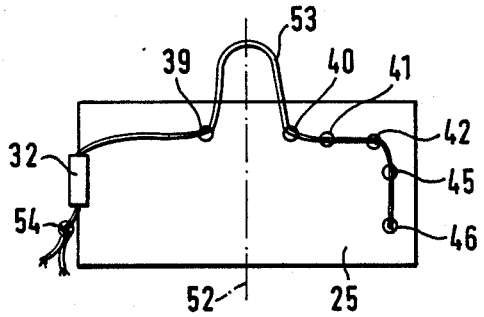
FIG. 7 is the pattern according to FIG. 6 double-folded to constitute a carrying bag, without the smaller pocket.

When the objects to be stowed within the bag have been deposited onto the inner side of the pattern and the pattern has been folded about the first folding line 20 and has been closed along the closure elements 26, the next folding is performed about the second folding line 21. Now the two free ends 32 and 33 of the cord, as shown in FIG. 7 at knot 54, may releasably be knotted withone another whereby the bag retains the double-folded state. Subsequently, the bag may be gripped at the two sections of the cord between the rings 35 and 36, or 39 and 40, respectively, whereby the handles are formed as in accordance with handle 53 shown in FIG. 7 and the bag may safely be carried. In FIG. 7, the carrying bag is shown unloaded, in contrast to the representation in FIG. 2.

It is to be understood that the invention is not limited to the features and embodiments hereinabove specifically set forth but may be carried out in other ways without departure from its spirit.

I claim:

1. A carrying bag comprising a substantially rectangular flexible sheet article folded about a folding line that notionally divides the sheet article into two portions each having an inner side and plural outer edges, such that said two portions are arranged in overlapping relation with their inner sides facing each other and are secured to each other along at least two of said outer edges, wherein the improvement comprises (a) releasable closure means mounted on the inner sides of said two portions along outer edges thereof for securing said portions to each other as aforesaid;

(b) plural guiding elements, mounted on one of said portions, for movably holding a cord extending substantially along the outer edges thereof; and (c) a cord movably held by said guiding elements and having opposed ends secured adjacent said folding line.

2. A carrying bag comprising a substantially rectangular flexible sheet article folded about a first folding line, perpendicular to the long dimension of said sheet article, that notionally divides the sheet article into two portions each having an inner side and plural outer edges, such that said two portions are arranged in overlapping relation with their inner sides facing each other and are secured to each other along at least two of said outer edges, wherein the improvement comprises (a) releasable closure means mounted on the inner sides of said two portions along outer edges thereof for securing said portions to each other as aforesaid;

(b) plural guiding elements, mounted on one of said portions, for movably holding a cord extending substantially along the outer edges thereof, at least two of said guiding elements being mounted on said one portion along said folding line respectively adjacent two of said outer edges; and (c) a cord movably held by said guiding means and having opposed free ends respectively extending through said two guiding elements so as to be frictionally connectable to each other upon folding of the bag along a second folding line generally parallel to the long dimension of said sheet article.

3. A bag as defined in claim 1, wherein said one portion has an outer side and said plural guiding elements are disposed on said outer side in spaced relation to each other along the length of said cord such that said cord is exposed between adjacent guiding elements.

4. A bag as defined in claim 2, wherein said one portion has an outer side and said plural guiding elements are disposed on said outer side in spaced relation to each other along the length of said cord such that said cord is exposed between adjacent guiding elements.

5. A bag as defined in claim 2, wherein said plural guiding elements include at least two further guiding elements symmetrically disposed, adjacent an outer edge of said one portion, relative to a notional median of said one portion perpendicular to the long dimension of said sheet article.

6. A bag as defined in claim 2, wherein said two guiding elements are each short with respect to said folding line and are secured by sewing to said one portion, and wherein said plural guiding elements further include a plurality of rings.

7. A bag as defined in claim 5, wherein said first-mentioned two guiding elements are each short with respect to said folding line and are secured by sewing to said one portion, and wherein all others of said plural guiding elements are rings.

8. A bag as defined in claim 1, wherein said sheet article has an outer side, and further including a strip, for serving as a handle for the bag, mounted on said outer side between said ends of said cord and extending parallel to said folding line.

9. A bag as defined in claim 1, further including a plurality of fastening elements mounted on the inner sides of said two portions in generally parallel relation to said closure elements for releasably engaging a corresponding plurality of fastening elements mounted on a towel to secure the towel to the sheet article.

10. A bag as defined in claim 2, further including fastening means mounted on the inner sides of said two portions in generally parallel relation to said closure elements for releasably engaging cooperating fastening means mounted on a towel to secure the towel to the sheet article.

11. A bag as defined in claim 1, wherein said closure elements comprise strips of material bearing multiple flexible hooks and/or multiple flexible loops engageable by said hooks, extending along outer edges of said two portions.

12. A bag as defined in claim 2, wherein said closure elements comprise strips of material bearing multiple flexible hooks and/or multiple flexible loops engageable by said hooks, extending along outer edges of said two portions.

13. A bag as defined in claim 1, wherein said closure elements are press buttons disposed in spaced relation along the outer edges of said two portions.

14. A bag as defined in claim 2, wherein said closure elements are press buttons disposed in spaced relation along the outer edges of said two portions.

15. A bag as defined in claim 9, wherein said fastening means comprise strips of material bearing multiple flexible hooks and/or multiple flexible loops engageable by said hooks.

16. A bag as defined in claim 10, wherein said fastening means comprise strips of material bearing multiple flexible hooks and/or multiple flexible loops engageable by said hooks.

17. A bag as defined in claim 9, wherein said fastening means comprise press buttons disposed in spaced relation to each other.

18. A bag as defined in claim 10, wherein said fastening means comprise press buttons disposed in spaced relation to each other.

19. A bag as defined in claim 1, wherein said sheet article has an outer side, and further including a pocket secured by sewing to said outer side.

20. A bag as defined in claim 2, wherein said sheet article has an outer side, and further including a pocket secured by sewing to said outer side.

21. A bag as defined in claim 1, further including an upwardly opening pocket, smaller than either of said portions, and fastening elements respectively mounted on the pocket and on the inner side of one of said portions for securing the pocket to the last-mentioned portion.

22. A bag as defined in claim 2, further including an upwardly opening pocket, smaller than either of said portions, and fastening elements respectively mounted on the pocket and on the inner side of one of said portions for securing the pocket to the last-mentioned portion.

23. A bag as defined in claim 1, wherein said sheet article comprises a textile material.

24. A bag as defined in claim 2, wherein said sheet article comprises a textile material.

25. A bag as defined in claim 1, wherein said sheet article comprises an artificial textile material.

26. A bag as defined in claim 2, wherein said sheet article comprises an artificial textile material.

* * * * *